US007493883B2

(12) United States Patent
Takahashi

(10) Patent No.: US 7,493,883 B2
(45) Date of Patent: Feb. 24, 2009

(54) DILUTED OIL REGENERATION IN INTERNAL COMBUSTION ENGINE

(75) Inventor: Kazuhiko Takahashi, Yokohama (JP)

(73) Assignee: Nissan Motor Co., Ltd., Yokohama-shi (JP)

( * ) Notice: Subject to any disclaimer, the term of this patent is extended or adjusted under 35 U.S.C. 154(b) by 0 days.

(21) Appl. No.: 11/637,717

(22) Filed: Dec. 13, 2006

(65) Prior Publication Data

US 2007/0131193 A1 Jun. 14, 2007

(30) Foreign Application Priority Data

Dec. 14, 2005 (JP) ..... 2005-360074

(51) Int. Cl.
*F01M 1/00* (2006.01)

(52) U.S. Cl. ..... 123/196 AB; 123/41.09; 123/41.14

(58) Field of Classification Search ..... 123/196 R, 123/196 AB, 196 S, 41.14, 41.33, 1 A, 435, 123/543, 557, 41.09; 73/117.2, 117.3, 118.1, 73/53.05

See application file for complete search history.

(56) References Cited

U.S. PATENT DOCUMENTS 4,007,629 A * 2/1977 Hochstein ..... 73/53.05
6,535,001 B1 * 3/2003 Wang ..... 324/698
6,580,366 B1 * 6/2003 Engfehr ..... 340/457.4
6,590,402 B2 * 7/2003 Wang et al. ..... 324/698
6,750,763 B2 * 6/2004 Ismail et al. ..... 340/450.3
7,043,903 B2 * 5/2006 Onodera et al. ..... 60/295
7,104,050 B2 * 9/2006 Sato et al. ..... 60/295
7,188,514 B2 * 3/2007 Blomkvist et al. ..... 73/53.05
7,269,496 B2 * 9/2007 Honda et al. ..... 701/104
2005/0188685 A1 * 9/2005 Folliot ..... 60/286

FOREIGN PATENT DOCUMENTS

EP 1798387 A2 * 6/2007
JP 2002-266619 A 9/2002
JP 2002-364436 A 12/2002
JP 2007-162569 * 6/2007

* cited by examiner

*Primary Examiner*—Hai H Huynh
(74) *Attorney, Agent, or Firm*—Foley & Lardner LLP

(57) ABSTRACT

An internal combustion engine (10) for a vehicle comprises a fuel injector (12) which supplies fuel to a combustion chamber formed in a piston (1), and an oil pan which stores engine oil below the piston (1). With regard to a phenomenon whereby the engine oil is diluted with the fuel injected by the fuel injector (12), a controller (90) determines whether or not the engine oil needs to be regenerated (S13). When the engine oil needs to be regenerated, the controller (90) switches a cooling water path in the engine (10) by controlling an electrically controlled thermostat (74), and raises the temperature of the engine oil over a predetermined time period (S15, S17). As a result of this temperature increase, the fuel in the engine oil is vaporized, thereby reducing the dilution ratio of the engine oil, and thus the engine oil is regenerated.

10 Claims, 11 Drawing Sheets

DILUTED OIL REGENERATION IN INTERNAL COMBUSTION ENGINE

FIELD OF THE INVENTION

This invention relates to the regeneration of engine oil that has been diluted with injected fuel in an internal combustion engine.

BACKGROUND OF THE INVENTION

As an exhaust gas filter which traps particulate matter contained in the exhaust gas of an internal combustion engine to prevent the particulate matter from being discharged into the atmosphere continues to trap particulate matter, eventually the trapped particulate matter causes a blockage. In such a case, a regeneration operation must be performed to raise the temperature of the exhaust gas so that the accumulated particulate matter is forcibly burned and removed.

JP2002-364436A, published by the Japan Patent Office in 2002, proposes supplying a catalyst disposed upstream of an exhaust gas filter with unburned hydrocarbon by performing a so-called post-injection, in which additional fuel is injected, during the expansion stroke of an internal combustion engine, and raising the temperature of the filter using heat generated by the catalytic reaction of the unburned hydrocarbon.

SUMMARY OF THE INVENTION

The post-injected fuel flows out from an exhaust passage, and also sticks to a cylinder wall surface of the internal combustion engine. The fuel that sticks to the cylinder wall surface may be scraped into a lower oil pan by a piston ring of a piston, and engine oil stored in the oil pan may be diluted with the fuel. When the engine oil is diluted with the fuel, it may become impossible for the engine oil to exhibit a sufficient lubricating performance.

JP2002-266619A, published by the Japan Patent Office in 2002, proposes a fuel/oil separation device for regenerating diluted engine oil.

In this prior art, the diluted engine oil in the oil pan is heated in a pressure tank, whereupon vaporized fuel is condensed in a condenser and returned to a fuel tank. Accordingly, the separation device must comprise equipment such as a pressure tank, a heater, a condenser, and piping, and therefore special equipment is required to regenerate the engine oil. Moreover, thermal energy is inevitably consumed in the engine oil regeneration process.

It is therefore an object of this invention to regenerate engine oil without the need for special equipment and without supplying thermal energy.

In order to achieve the above object, this invention provides a diluted oil regeneration device which regenerates an engine oil diluted with a fuel in an internal combustion engine for a vehicle. The engine comprises a piston which is lubricated by the engine oil and a fuel injector which supplies the fuel to a combustion chamber formed by the piston. The diluted oil regeneration device comprises a mechanism which raises a temperature of the engine oil, and a programmable controller programmed to determine whether or not the engine oil needs to be regenerated, and control the mechanism to raise the temperature of the engine oil over a predetermined time period, when the engine oil needs to be regenerated.

This invention also provides a diluted oil regeneration method for the internal combustion engine. The method comprises determining whether or not the engine oil needs to be regenerated, and raising the temperature of the engine oil over a predetermined time period, when the engine oil needs to be regenerated.

The details as well as other features and advantages of this invention are set forth in the remainder of the specification and are shown in the accompanying drawings.

DESCRIPTION OF THE PREFERRED EMBODIMENTS

First, points of this invention will be described to facilitate understanding thereof.

Figures 11A, 11B, 11C, 11D:
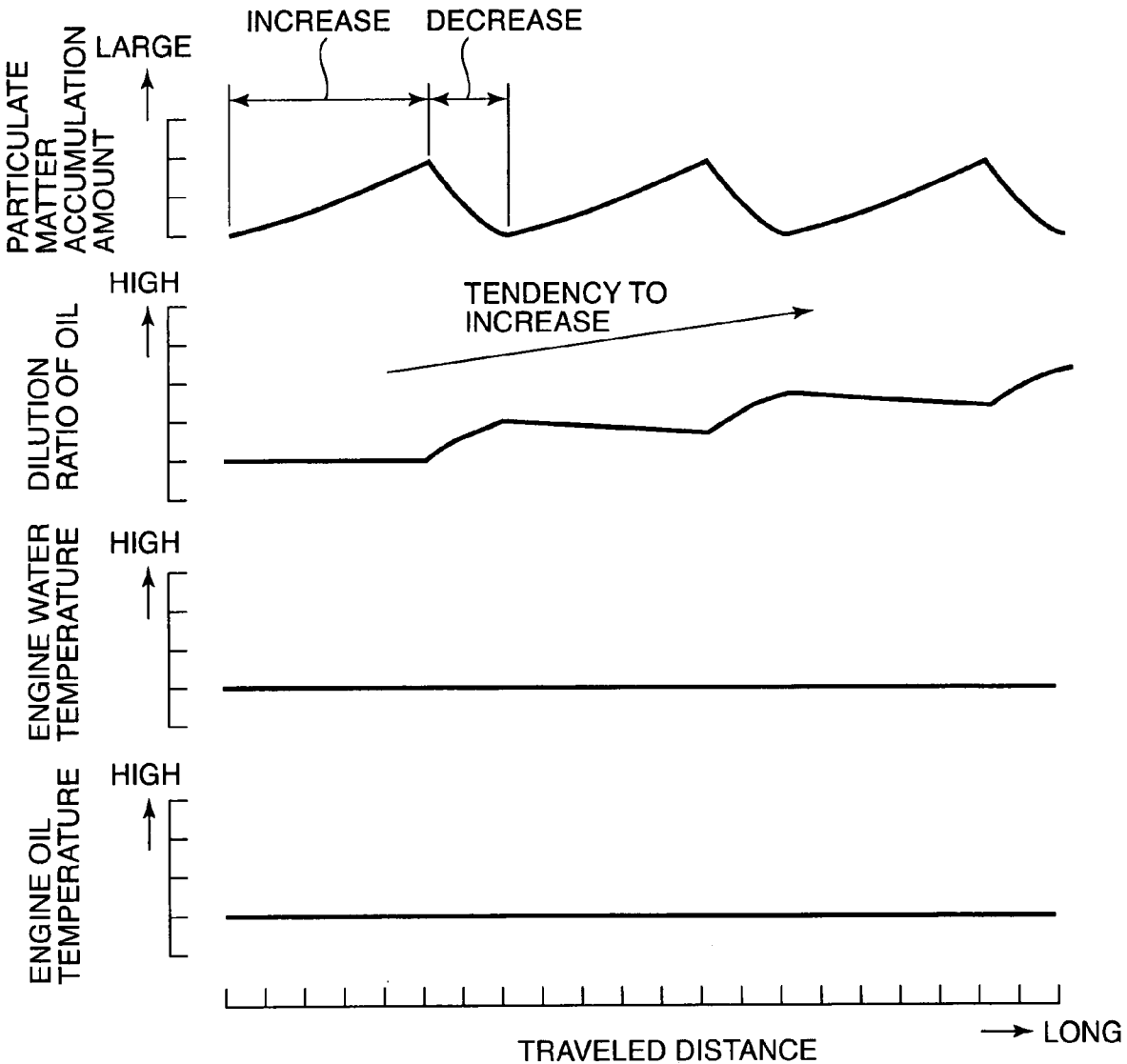
FIG. 11A PRIOR ART
FIG. 11B PRIOR ART
FIG. 11C PRIOR ART
FIG. 11D PRIOR ART
FIGS. 11A-11D are timing charts illustrating states in which engine oil is diluted according to the prior art.

Referring to FIGS. 11A-11D, in the aforementioned JP2002-364436A, when a predetermined amount of particulate matter has accumulated in an exhaust gas filter of an internal combustion engine, the accumulated particulate matter is forcibly burned and removed such that the particulate matter accumulation amount decreases, as shown in FIG. 11A. To perform this operation, a post-injection of fuel is executed in the expansion stroke of the internal combustion engine so that a catalyst disposed upstream of the exhaust gas filter is supplied with unburned hydrocarbon.

The catalyst oxidizes the unburned hydrocarbon through a catalytic reaction, and the temperature of the exhaust gas is raised by oxidation heat generated by the oxidation reaction. As noted above, however, a part of the post-injected fuel sticks to a cylinder wall surface and is scraped into an oil pan by a piston ring. As a result, engine oil stored in the oil pan is diluted, leading to an increase in the dilution ratio of the engine oil, as shown in FIG. 11B.

The fuel and engine oil have different vaporization temperatures, and therefore the fuel component can be vaporized by heating the diluted engine oil.

Figure 1:
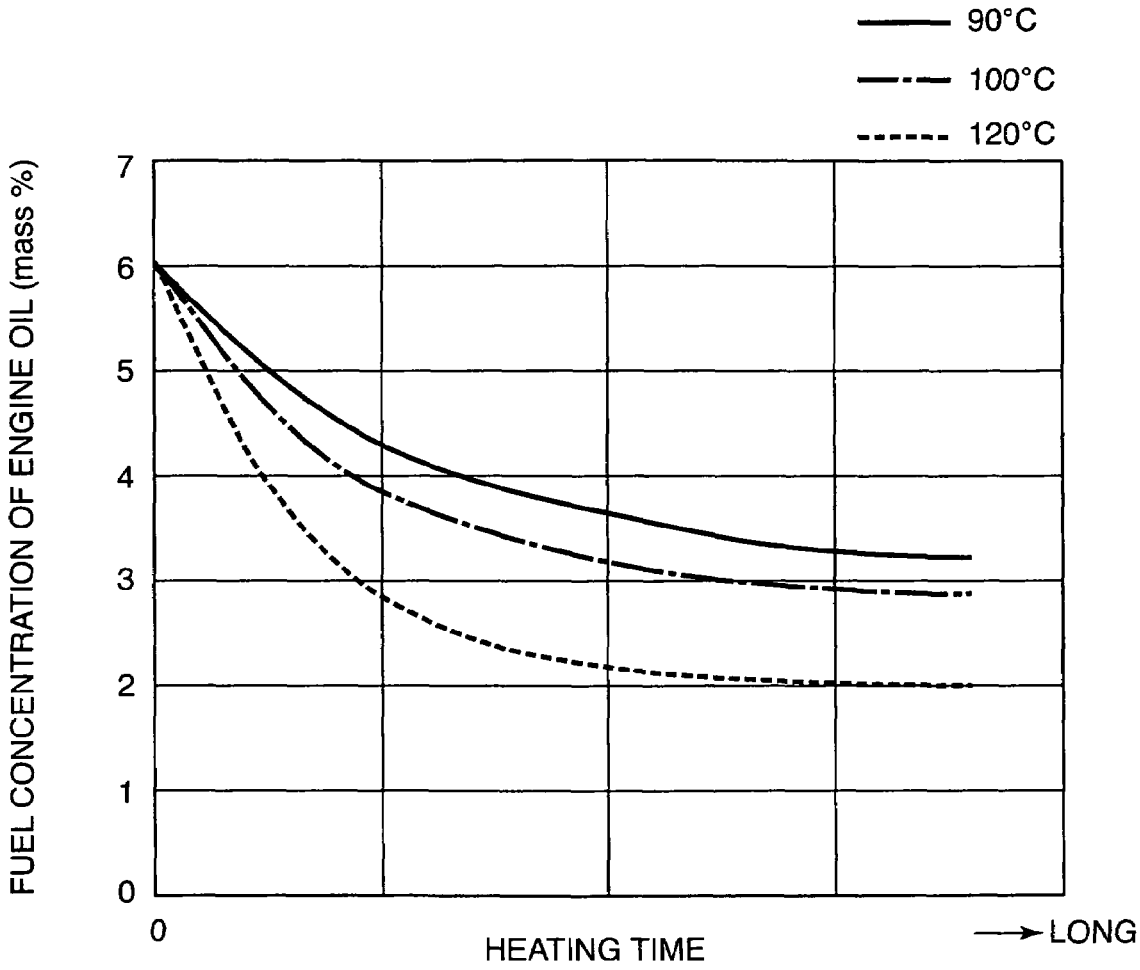
FIG. 1 is a diagram illustrating a relationship between a heating time and a heating temperature of engine oil diluted with fuel, and a fuel concentration of the oil.

Referring to FIG. 1 of the drawings, when engine oil containing 6% by weight of fuel is heated, the fuel concentration falls in accordance with the heating time. At this time, the fuel concentration falls more quickly as the heating temperature rises. It is therefore evident that the dilution of engine oil diluted with fuel can be eliminated by increasing the temperature of the engine oil. This invention has been designed on the basis of this knowledge possessed by the inventors.

Figure 2:
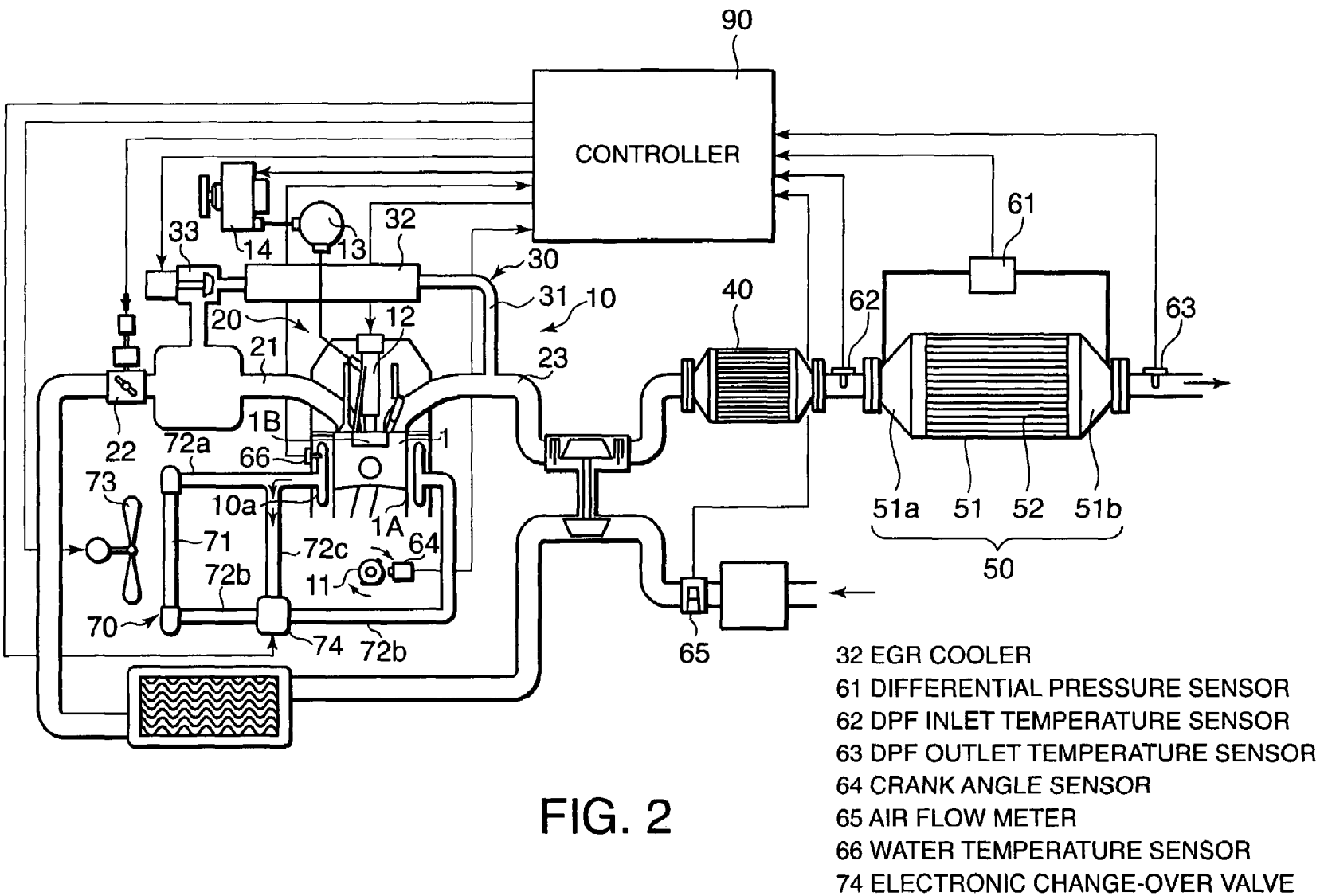
FIG. 2 is a schematic diagram of a diesel engine to which this invention is applied.

Referring to FIG. 2, in a multi-cylinder diesel engine 10 for a vehicle, a piston 1 is housed inside each cylinder 1A, and a combustion chamber 1B is formed above the piston 1. An oil pan storing engine oil which lubricates the piston 1 is provided below the piston 1.

An intake passage 21 and an exhaust passage 23 are connected to the combustion chamber 1B respectively via valves.

An intake throttle 22 which adjusts an intake fresh air amount is provided in the intake passage 21.

The diesel engine 10 comprises a fuel injection device 20 which supplies the combustion chamber 1B with fuel, an exhaust gas recirculation (EGR) device 30, a diesel oxidation catalyst (DOC) 40, a diesel particulate filter (DPF) assembly 50, and a water cooling device 70.

The fuel injection device 20 comprises a high pressure pump 14, a common rail 13 which stores fuel pressurized by the high pressure pump 14 temporarily, and fuel injectors 12 which inject the fuel in the common rail 13 into respective combustion chambers 1B of the diesel engine 10 at a predetermined injection timing.

The EGR device 30 comprises an EGR passage 31 which connects the exhaust passage 23 to a collector portion of the intake passage 21. An EGR cooler 32 and an EGR valve 33 are provided at points on the EGR passage 31. The EGR cooler 32 cools recirculated exhaust gas in the exhaust passage 23 using cooling water. The EGR valve 33 adjust the flow of the recirculated exhaust gas in the EGR passage 31.

The DOC 40 is provided in the exhaust passage 23. The DOC 40 is formed from palladium or platinum, and serves to reduce the amount of particulate matter in the exhaust gas through an oxidation action induced by the palladium or platinum. The DOC 40 also induces an oxidation reaction in hydrocarbon (HC) constituting the unburned component of the fuel, and heats the exhaust gas with the resultant reaction heat.

The DPF assembly 50 is provided downstream of the DOC 40 in the exhaust passage 23. The DPF assembly 50 comprises a DPF 52 housed in a DPF housing 51. The DPF 52 has a porous, honeycomb structure and is constituted by a ceramic such as cordierite.

The inside of the DPF 52 has a matrix-shaped transverse section formed by porous thin walls, and each of the spaces defined by the thin walls constitutes an exhaust gas flow passage. The openings of the flow passages are alternately sealed. More specifically, the flow passages whose inlet is not sealed have a sealed outlet and the flow passages whose outlet is not sealed have a sealed inlet.

Exhaust gas flowing into the DPF 52 passes through the porous thin walls defining the flow passages, and is discharged to the downstream side. The particulate matter contained in the exhaust gas is trapped on the porous thin walls and accumulates there.

The trapped particulate matter is burned in the DPF 52. However, combustion of the particulate matter is dependent on the bed temperature of the DPF 52, and if the bed temperature is low, the amount of combustion decreases such that the particulate matter accumulation amount exceeds the particulate matter combustion amount. If particulate matter continues to be trapped by the DPF 52 in this state, eventually a blockage occurs in the DPF 52. When a certain amount of particulate matter has accumulated, a regeneration operation is performed to forcibly remove the accumulated particulate matter through combustion by raising the temperature of the exhaust gas.

The water cooling device 70 comprises a radiator 71, cooling passages 72*a*-72*c*, a cooling fan 73, and an electrically controlled thermostat 74.9

The cooling passages 72*a*-72*c* are constituted by a first passage 72*a* which leads cooling water from a water-cooling water jacket 10*a* of the diesel engine 10 to the radiator 71, a second passage 72*b* which returns the cooling water cooled by the radiator 71 to the water jacket 10*a*, and a bypass passage 72*c* which returns cooling water used to cool the diesel engine 10 to the water jacket 10*a* without passing through the radiator 71.

The cooling fan 73 is disposed opposite the radiator 71. The cooling fan 73 promotes the heat radiation action of the radiator 71 by forcibly transmitting a wind to the radiator 71.

The electrically controlled thermostat 74 is provided in a confluence portion between the second passage 72*b* and the bypass passage 72*c*. The electrically controlled thermostat 74 is switched selectively between a closed position and an open position. In the closed position, the electrically controlled thermostat 74 closes the radiator 71 side of the second passage 72*b* such that the flow of cooling water from the radiator 71 to the water jacket 10*a* is cut off, and opens the bypass passage 72*c* side so that the cooling water can flow from the bypass passage 72*c* to the water jacket 10*a*. In the open position, the electrically controlled thermostat 74 opens the radiator 71 side of the second passage 72*b* so that the cooling water can flow from the radiator 71 to the water jacket 10*a*, and closes the bypass passage 72*c* side such that the flow of cooling water from the bypass passage 72*c* to the second passage 72*b* is cut off.

The opening of the intake throttle 22, operations of the high pressure pump 14, the fuel injection amount and injection timing of the fuel injectors 12, the opening of the EGR valve 33, operations of the cooling fan 73, and switching of the electrically controlled thermostat 74 are controlled by control signals output by a programmable controller 90.

The controller 90 is constituted by a microcomputer comprising a central processing unit (CPU), read-only memory (ROM), random access memory (RAM), and an input/output interface (I/O interface). The controller 90 may be constituted by a plurality of microcomputers.

To realize the above control executed by the controller 90, various sensors are connected to the controller 90 by a signal circuit, and detection data from the respective sensors are input into the controller 90 as signals.

A differential pressure sensor 61 detects a differential pressure ΔP between an upstream chamber 51*a* of the DPF housing 51, corresponding to the inlet of the DPF 52, and a downstream chamber 51*b* of the DPF housing 51, corresponding to the outlet of the DPF 52. A DPF inlet temperature sensor 62 detects an inlet temperature Tin of the DPF 52. A DPF outlet temperature sensor 63 detects an outlet temperature Tout of the DPF 52. A crank angle sensor 64 detects a rotation position and a rotation speed of a crankshaft 11 of the diesel engine 10. An air flow meter 65 detects an amount of intake fresh air taken into the diesel engine 10. A water temperature sensor 66 detects the temperature of the cooling water in the diesel engine 10.

The controller 90 adjusts the fuel injection amount and injection timing by controlling the fuel injectors 12 and the high pressure pump 14 on the basis of an input signal. The controller 90 adjusts the opening of the intake throttle 22 on the basis of an input signal. The controller 90 also duty-controls the EGR valve 33. Through this control, the controller 90 controls the excess air factor, and therefore the air-fuel ratio of an air-fuel mixture that is burned in the combustion chamber 1B. This control will be referred to as/control. The controller 90 increases the unburned component, i.e. the amount of hydrocarbon (HC), of the exhaust gas through the/control, and performs the regeneration operation described above on the DPF 52 by raising the temperature of the exhaust gas that flows out from the DOC 40. Specifically, the fuel injectors 12 are respectively caused to execute a post-injection.

All of the control described above is well known.

The controller 90 also adjusts the cooling water temperature by controlling the cooling fan 73 and electrically controlled thermostat 74 on the basis of the cooling water temperature.

As described above, when the fuel injector 12 performs a post-injection to regenerate the DPF 52, a part of the injected fuel sticks to the wall surface of the cylinder 1A, and the adhered fuel is scraped into the oil pan therebelow by the piston ring of the piston 1. As a result, the engine oil in the oil pan may be diluted with the fuel.

Figure 3:
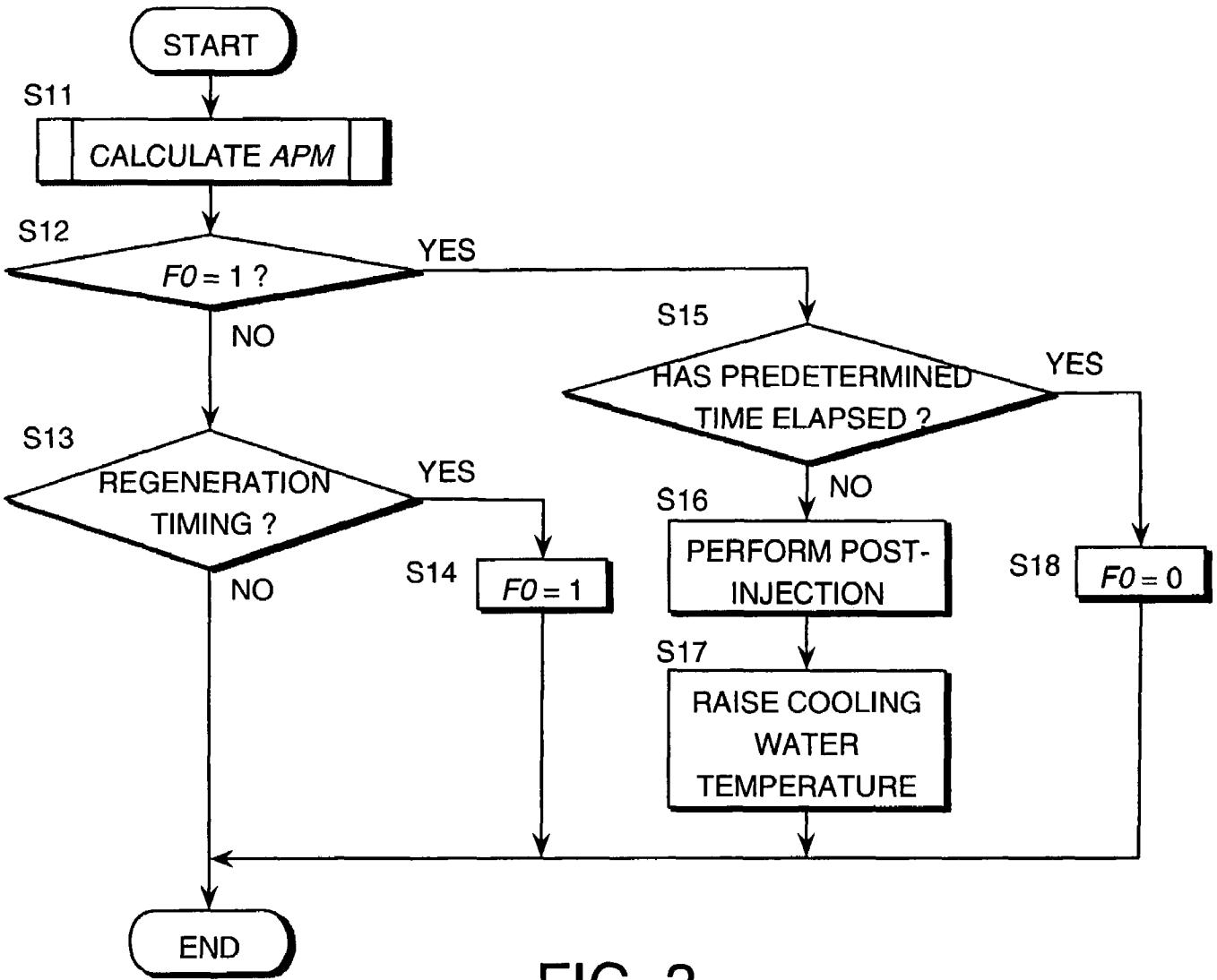
FIG. 3 is a flowchart illustrating a DPF regenerating routine executed by a controller according to this invention.

The controller 90 regenerates the engine oil diluted in this manner as part of a DPF regenerating routine shown in FIG. 3. This routine is executed at fixed time intervals, for example 10 millisecond intervals, while the diesel engine 10 is operative.

Figure 4:
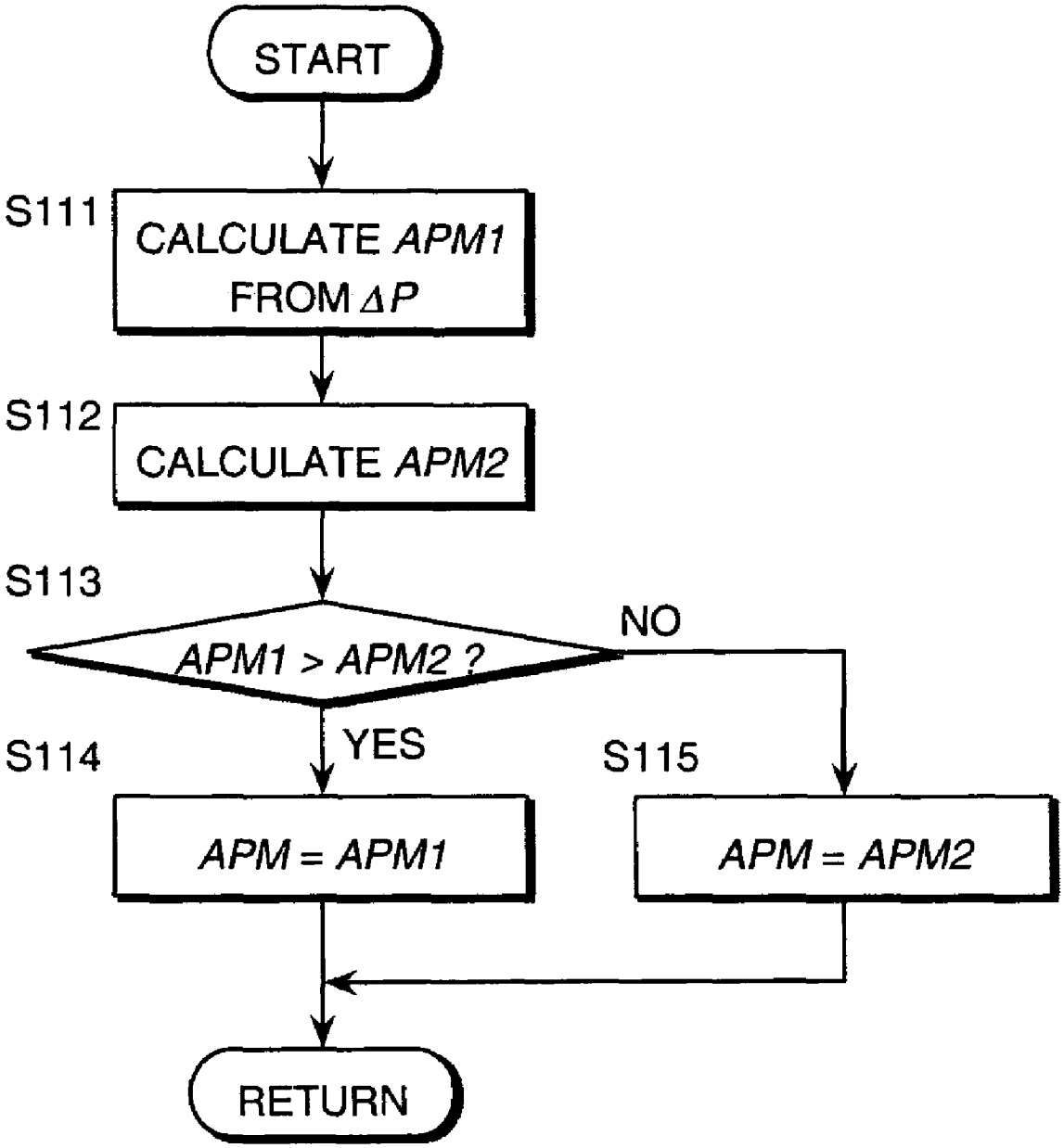
FIG. 4 is a flowchart illustrating a particulate matter accumulation amount estimating subroutine executed by the controller.

Referring to FIG. 3, in a step S11 the controller 90 calculates a particulate matter accumulation amount APM that has accumulated in the DPF 52 using a subroutine shown in FIG. 4. The content of this subroutine will be described later.

Next, in a step S12, the controller 90 determines whether or not a flag F0 is at unity. The flag F0 is set to unity when the regeneration timing of, the DPF 52 arrives, and reset to zero when regeneration of the DPF 52 is complete. The initial value of the flag F0 is zero.

When the flag F0 is not at unity, the controller 90 performs the processing of a step S13.

In the step S13, the controller 90 determines whether or not the regeneration timing of the DPF 52 has arrived on the basis of the particulate matter accumulation amount APM of the DPF 52. More specifically, the controller 90 determines whether or not the particulate matter accumulation amount APM has reached a predetermined amount, and if the particulate matter accumulation amount APM has reached the predetermined amount, the controller 90 determines that the regeneration timing has arrived.

When it is determined that the regeneration timing has arrived, the controller 90 sets the flag F0 to unity in a step S14, and then terminates the routine.

When it is determined that the regeneration timing has not arrived, the controller 90 terminates the routine immediately.

Meanwhile, when the flag F0 is at unity in the step S12, the controller 90 performs the processing of a step S15, and determines whether or not the amount of time that has elapsed since the beginning of regeneration of the DPF 52 has reached a predetermined regeneration period. The regeneration period is a value set in advance as a period required to complete the operation to regenerate the DPF 52.

When the determination of the step S15 is affirmative, the controller 90 resets the flag F0 to zero in a step S18, and then terminates the routine.

When the determination of the step S15 is negative, the controller 90 forcibly burns the particulate matter that has accumulated in the DPF 52. For this purpose, the post-injection disclosed in the aforementioned JP2002-364436A is executed in a step S16. More specifically, fuel is injected from the fuel injector 12 during the expansion stroke of the diesel engine 10. As a result, unburned hydrocarbon (HC) is supplied to the DOC 40, and the particulate matter that has accumulated in the DPF 52 is burned by heat generated through an oxidation reaction of the HC, which is induced by the catalyst of the DOC 40.

Next, in a step S17, the controller 90 raises the cooling water temperature by controlling the electrically controlled thermostat 74. More specifically, the electrically controlled thermostat 74 is set in the closed position. As a result, the cooling water in the water jacket 10*a* is circulated through the bypass passage 72*c* without being cooled by the radiator 71, leading to an increase in the temperature of the cooling water. As a result, the temperature of the diesel engine 10 rises, thereby accelerating vaporization of the post-injected fuel, and hence the amount of fuel sticking to the wall surface of the cylinder 1A decreases. When the amount of adhered fuel decreases, the amount of fuel that is scraped into the oil pan also decreases. Furthermore, by increasing the temperature of the diesel engine 10, the fuel contained in the engine oil is vaporized. Accordingly, the proportion of fuel contained in the engine oil in the oil pan decreases such that the diluted engine oil is regenerated to its original state, i.e. having a low fuel content. Following the processing of the step S17, the controller 90 terminates the routine.

Next, referring to FIG. 4, the subroutine executed in the step S11 will be described.

In a step S111, the controller 90 determines a first particulate matter accumulation amount APM1 in the DPF 52 from the differential pressure ΔP between the upstream chamber 51*a* and downstream chamber 51*b* of the DPF housing 51, which is detected by the differential pressure sensor 61, by referring to a particulate matter accumulation amount map, which is stored in the ROM in advance. The particulate matter accumulation amount map is set in advance through experiment.

Next, in a step S112, the controller 90 calculates a second particulate matter accumulation amount APM2 using the following method.

First, on the basis of the rotation speed and load of the diesel engine 10, the controller 90 determines a particulate matter discharge amount of the diesel engine 10 within a fixed time period by referring to a particulate matter discharge amount map, which is stored in the ROM in advance. This subroutine is always executed upon each execution of the routine in FIG. 3, and therefore, if the fixed time period is set equally to the execution interval of the main routine shown in FIG. 3, the determined particulate matter discharge amount is equal to a particulate matter discharge amount APM21 of the diesel engine 10 within a period extending from the previous execution of the routine to the current execution of the routine.

The controller 90 also determines a particulate matter combustion amount APM22 within the same fixed time period from a second particulate matter accumulation amount APM2*z* calculated in the step S112 during the previous execution of the subroutine, the bed temperature of the DPF 52, and the inlet temperature Tin of the DPF 52, by referring to a particulate matter combustion amount map stored in the ROM in advance. Then, by adding a value obtained by subtracting the particulate matter combustion amount APM22 within the fixed time period from the particulate matter discharge amount APM21 within the fixed time period to the second particulate matter accumulation amount APM2*z* calculated during the previous execution of the subroutine, or in other words using the following Equation (1), the second particulate matter accumulation amount APM2 at the current time is calculated.

$$APM2=APM2z+APM21-APM22 \quad (1)$$

The particulate matter discharge amount map and the particulate matter combustion amount map are both set in advance through experiment.

Next, in a step S113, the controller 90 compares the first particulate matter accumulation amount APM1, which is based on the differential pressure ΔP, with the second particulate matter accumulation amount APM2, which is calculated using the running conditions of the diesel engine 10.

When the first particulate matter accumulation amount APM1 is greater than the second particulate matter accumulation amount APM2 in the step S113, the controller 90 sets the first particulate matter accumulation amount APM1 as the particulate matter accumulation amount APM in a step S114, and then terminates the subroutine.

When the first particulate matter accumulation amount APM1 is not greater than the second particulate matter accumulation amount APM2 in the step S113, the controller 90 sets the second particulate matter accumulation amount APM2 as the particulate matter accumulation amount APM in a step S115, and then terminates the subroutine.

Referring to FIGS. 5A-5D, the results of execution of the DPF regenerating routine will now be described. It should be noted that in these timing charts, the traveled distance of the vehicle is set on the abscissa.

While the particulate matter accumulation amount APM of the DPF 52 is small, the controller 90 executes the processing from the step S11 through the step S13 to END upon each execution of the DPF regenerating routine.

Figures 5A, 5B, 5C, 5D:
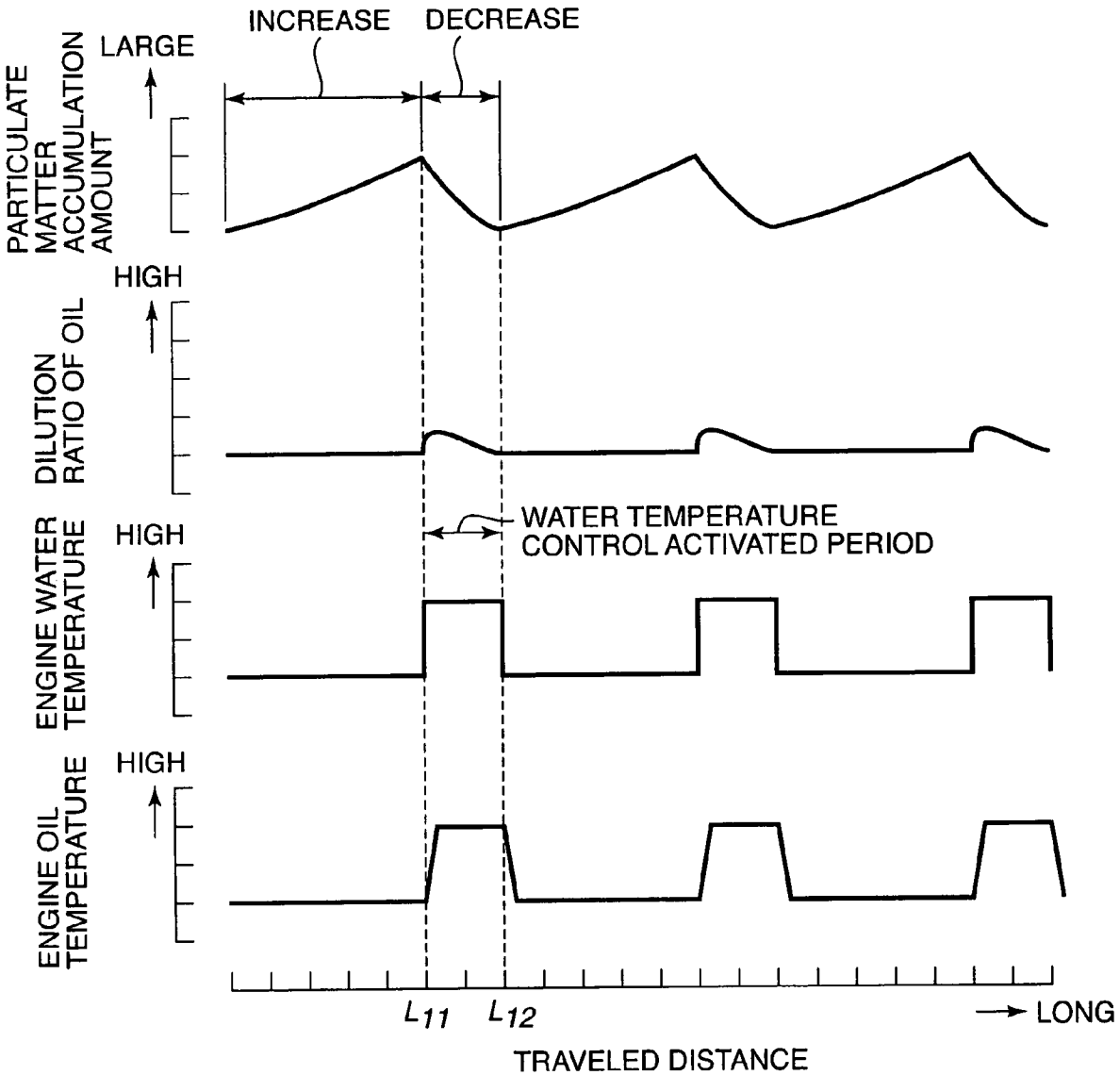
FIGS. 5A-5D are timing charts illustrating the results of execution of the DPF regenerating routine.

The particulate matter accumulation amount APM increases as shown in FIG. 5A, and when the traveled distance reaches L11, the particulate matter accumulation amount APM reaches the predetermined amount in the step S13 and the flag F0 is set at unity in the step S14. Accordingly, from the next execution of the routine onward, the controller 90 regenerates the DPF 52. More specifically, upon each execution of the routine, the controller 90 executes the processing of the steps S11, S12, and S15-S17. In the step S16, the fuel injectors 12 execute a post-injection, causing the temperature of the exhaust gas to rise such that the particulate matter that has accumulated in the DPF 52 is forcibly burned. As a result, the particulate matter accumulation amount decreases from the traveled distance L11 onward, as shown in the figure. Simultaneously, the cooling water temperature and the engine oil temperature of the diesel engine 10 are both increased by the processing of the step S17, as shown in FIGS. 5C and 5D. As a result, vaporization of the fuel contained in the engine oil is accelerated, and vaporization of the fuel post-injected by the fuel injector 12 is also accelerated. Therefore, the fuel dilution ratio of the engine oil decreases as shown in FIG. 5B.

At a traveled distance L12, the controller 90 determines that the regeneration time has reached the predetermined regeneration period in the step S15 and terminates the regeneration operation of the DPF 52. In other words, the controller 90 resets the flag F0 to zero in the step S18. Thereafter, the processing from the step S11 through the step S13 to END is executed upon each execution of the routine until the particulate matter accumulation amount APM reaches the predetermined amount again in the step S13.

By executing the DPF regenerating routine, the temperature of the diesel engine 10 is raised as the DPF 52 is regenerated. Hence, by executing the routine, the phenomenon whereby a part of the post-injected fuel used to regenerate the DPF 52 dilutes the engine oil can be prevented. Moreover, by executing the routine, the fuel component of the diluted engine oil can be removed.

By executing the DPF regenerating routine in the manner described above, engine oil can be regenerated without the need for special equipment. Moreover, the increase in the temperature of the diesel engine 10, which is required to regenerate the engine oil, is realized by altering the circulation path of the cooling water, and hence a specific thermal energy supply is not required to regenerate the engine oil.

Referring to FIG. 6 and FIGS. 7A-7D, a second embodiment of this invention will be described.

Figure 6:
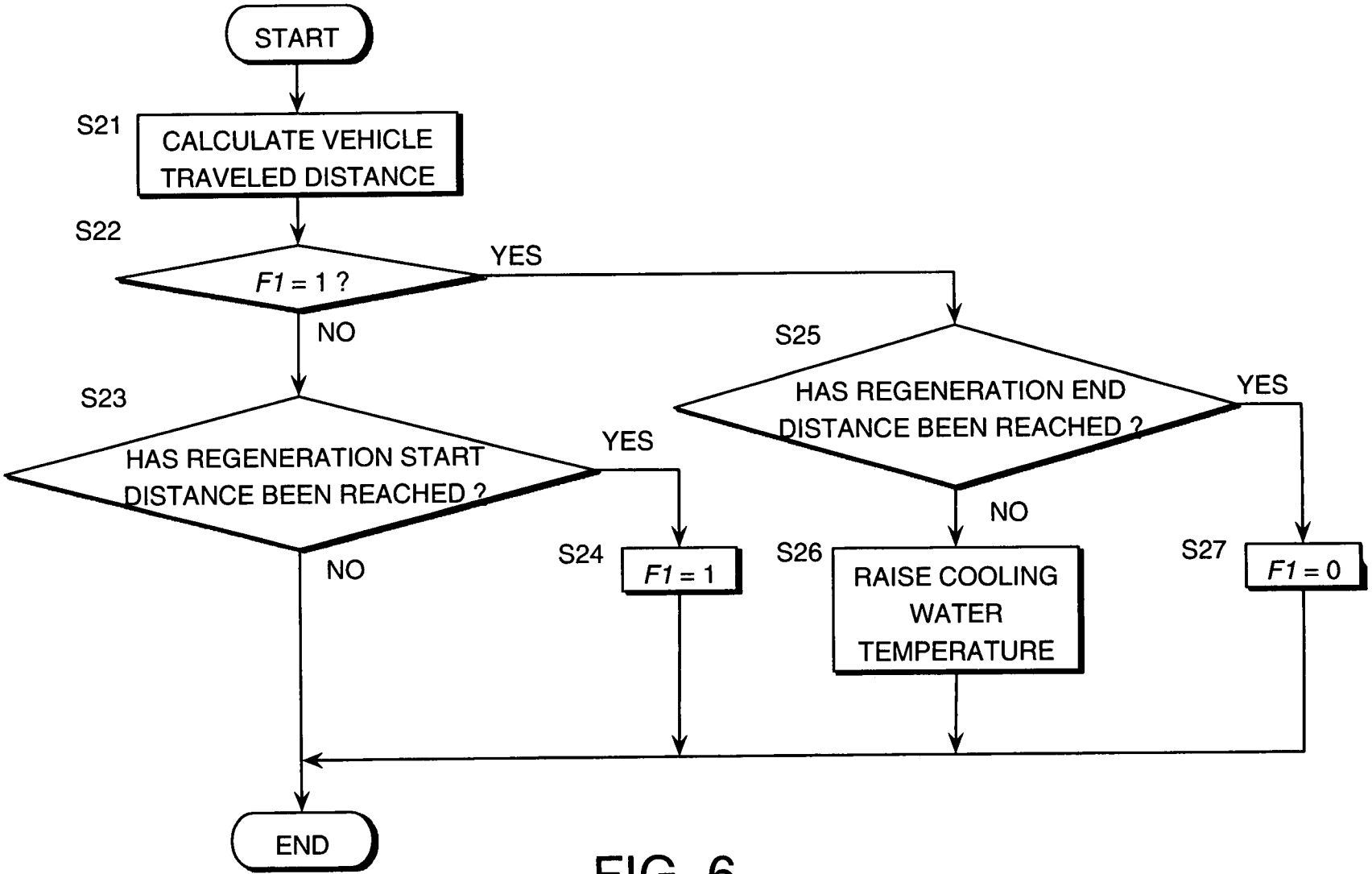
FIG. 6 is a flowchart illustrating a diluted oil regenerating routine executed by the controller, according to a second embodiment of this invention.

In this embodiment, the controller 90 executes a diluted oil regenerating routine shown in FIG. 6 instead of the DPF regenerating routine shown in FIG. 5. This routine is executed at fixed time intervals, for example 10 millisecond intervals, independently of control to regenerate the DPF 52.

This diluted oil regenerating routine may be performed along with a conventional DPF regenerating routine.

Referring to FIG. 6, in a step S21, the controller 90 calculates the traveled distance of the vehicle. More specifically, the controller 90 may calculate the traveled distance of the vehicle using a product of a gear ratio of a transmission device of the vehicle, which is set in accordance with the rotation speed and load of the diesel engine 10, and the rotation speed of the diesel engine 10, and calculate the traveled distance of the vehicle as an integrated value thereof. It should be noted, however, that the traveled distance may be obtained by various means, including an odometer provided in the vehicle. The traveled distance of the vehicle calculated in the step S21 is set as the traveled distance from the completion of engine oil regeneration. In other words, when an engine oil regeneration operation to be described below ends, the traveled distance is reset to zero.

Next, in a step S22, the controller 90 determines whether or not a flag F1 is at unity. The flag F1 is set to unity when the engine oil regeneration timing arrives, and reset to zero when engine oil regeneration ends. The initial value of the flag F1 is zero.

When the flag F1 is not at unity, the controller 90 determines in a step S23 whether or not the traveled distance of the vehicle has reached a predetermined regeneration start distance.

If the result of the determination indicates that the traveled distance of the vehicle has reached the predetermined regeneration start distance, the controller 90 sets the flag F1 to unity in a step S24, and then terminates the routine. If the traveled distance of the vehicle has not reached the predetermined regeneration start distance, the controller 90 terminates the routine immediately.

Meanwhile, when the flag F1 is at unity in the step S22, the controller 90 determines in a step S25 whether or not the traveled distance of the vehicle has reached a predetermined regeneration end distance.

If the result of the determination indicates that the traveled distance of the vehicle has reached the predetermined regeneration end distance, the controller 90 resets the flag F1 to zero in a step S27, and then terminates the routine. If the traveled distance of the vehicle has not reached the predetermined regeneration end distance, the controller 90 controls the electrically controlled thermostat 74 in a step S26 to raise the engine water temperature, similarly to the step S17 of the first embodiment. Following the processing of the step S26, the controller 90 terminates the routine.

The predetermined regeneration start distance and the predetermined regeneration end distance are set in advance through experiment.

Referring to FIGS. 7A-7D, the results of execution of this diluted oil regenerating routine will be described.

While the traveled distance of the vehicle is small, the controller 90 executes the processing from the step S21 through the step S23 to END upon each execution of the diluted oil regenerating routine.

When the traveled distance reaches L21, the traveled distance from the end of the previous regeneration reaches the predetermined regeneration start distance in the step S23, and the controller 90 sets the flag F1 to unity in the step S24.

In subsequent diluted oil regenerating routines, the controller 90 executes the processing of the step S26 upon each execution of the routine until the traveled distance from the end of the previous regeneration is determined to have reached the predetermined regeneration end distance in the step S25.

Figures 7A, 7B, 7C, 7D:
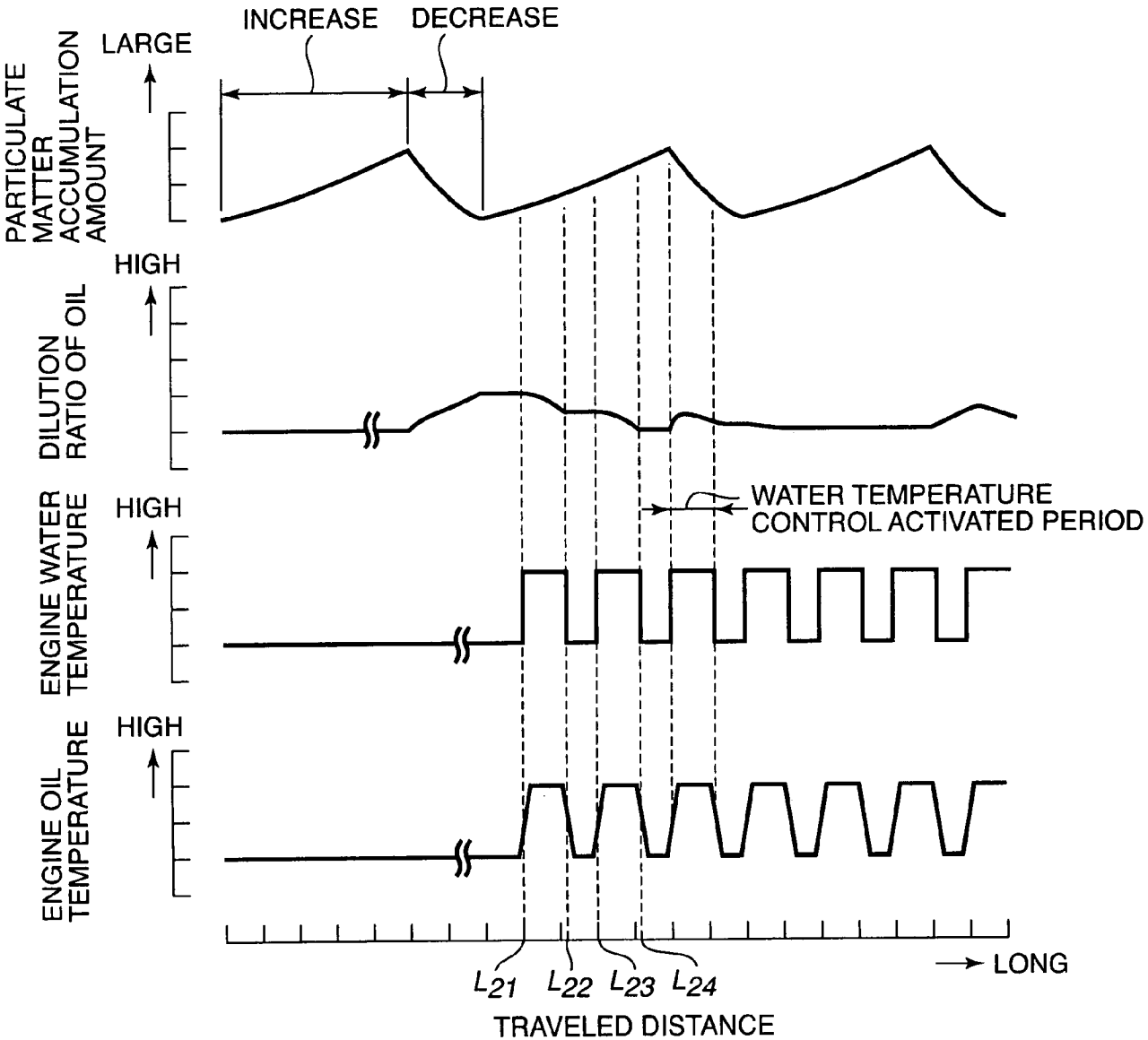
FIGS. 7A-7D are timing charts illustrating the results of execution of the diluted oil regenerating routine executed by the controller, according to the second embodiment of this invention.

As a result, as shown in FIGS. 7C and 7D, both the cooling water temperature and the engine oil temperature of the diesel engine 10 rise. Accordingly, vaporization of the fuel contained in the engine oil is accelerated, and vaporization of the fuel that is post-injected by the fuel injectors 12 is also accelerated. Therefore, the fuel dilution ratio of the engine oil decreases as shown in FIG. 7B.

At a traveled distance L22, the controller 90 determines in the step S25 that the traveled distance from the end of the previous regeneration has reached the predetermined regeneration end distance, and resets the flag F1 to zero in the step S27. Thereafter, the controller 90 again executes the processing from the step S21 through the step S23 to END up to a traveled distance L23, at which the traveled distance from the end of regeneration is determined to have reached the predetermined regeneration start distance in the step S23.

Thereafter, diluted oil regeneration is performed in a similar manner, i.e. within a fixed distance section and at fixed traveled distance intervals. In relation to the traveled distance shown in the figures, the section extending from L21 to L22 and the section extending from L23 to L24 correspond to the difference between the predetermined regeneration end distance and the predetermined regeneration start distance.

In this embodiment, as is evident from FIG. 7A, the diluted oil regenerating routine is performed independently of the operation to regenerate the DPF 52. However, by executing the diluted oil regenerating routine, the engine oil that is diluted by the post-injection performed to regenerate the DPF 52 is regenerated at fixed traveled distance intervals. According to this embodiment, similarly to the first embodiment, engine oil can be regenerated without the need for special equipment and without supplying specific thermal energy. Moreover, the beginning and end of regeneration are determined according to the traveled distance of the vehicle, and hence the determination requires no complicated calculations. As a result, the constitution of the diluted oil regeneration system can be simplified.

Referring to FIG. 8, FIG. 9, and FIGS. 10A-10D, a third embodiment of this invention will be described.

Figure 8:
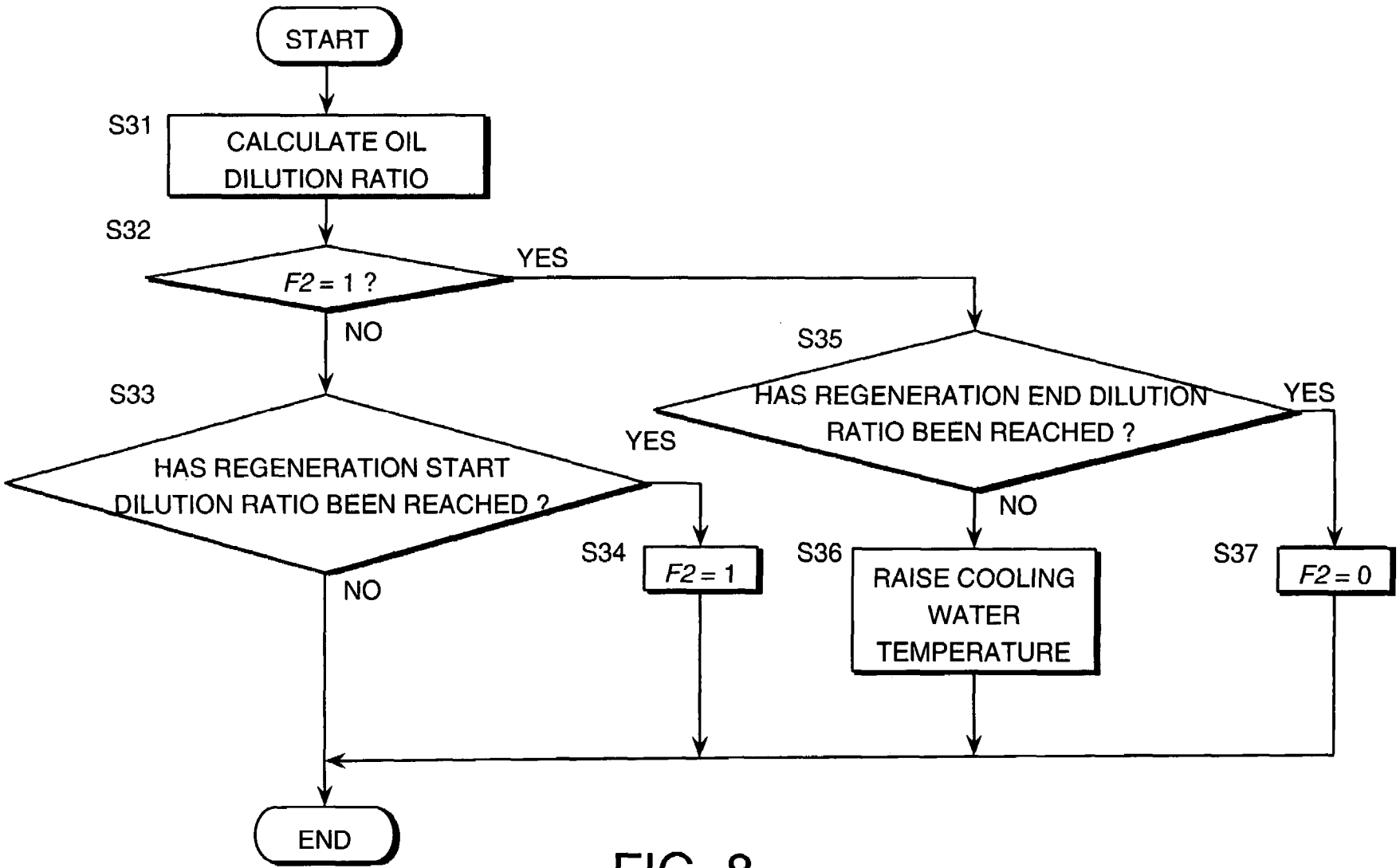
FIG. 8 is a flowchart illustrating a diluted oil regenerating routine executed by the controller, according to a third embodiment of this invention.
Figure 9:
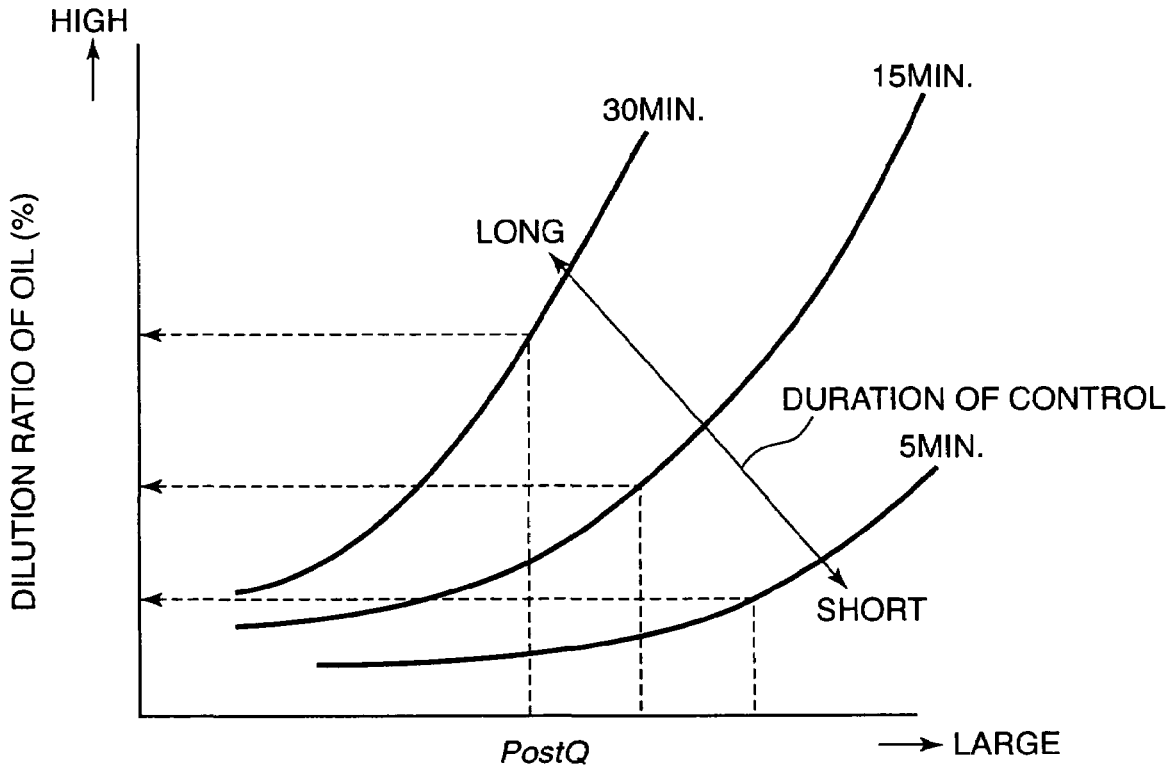
FIG. 9 is a diagram illustrating the characteristic of an oil dilution ratio map stored by the controller, according to the third embodiment of this invention.

In this embodiment, the controller 90* executes a diluted oil regenerating routine shown in FIG. 8 in place of the diluted oil regenerating routine of the second embodiment, shown in FIG. 6. This routine is also executed at fixed time intervals, for example 10 millisecond intervals, independently of control to regenerate the DPF 52.

This diluted oil regenerating routine may also be performed along with a conventional DPF regenerating routine.

Referring to FIG. 8, in a step S31, the controller 90 calculates the dilution ratio of the engine oil. More specifically, the controller 90 determines the dilution ratio of the engine oil from a flow rate PostQ of the post-injection from the fuel injector 12 and the duration (minutes) of the post-injection, by referring to a dilution ratio map having the characteristic shown in FIG. 9, which is stored in the ROM in advance. This map is set in advance through experiment such that the dilution ratio of the engine oil increases as the flow rate PostQ of the post-injection increases and the post-injection duration lengthens.

Next, in a step S32, the controller 90 determines whether or not a flag F2 is at unity. The flag F2 is set to unity when the engine oil regeneration timing arrives, and reset to zero when engine oil regeneration ends. The initial value of the flag F2 is zero.

When the flag F2 is not at unity, the controller 90 determines in a step S33 whether or not the dilution ratio of the engine oil has reached a predetermined regeneration start dilution ratio.

If the result of the determination indicates that the dilution ratio of the engine oil has reached the predetermined regeneration start dilution ratio, the controller 90 sets the flag F2 to unity in a step S34, and then terminates the routine. If the dilution ratio of the engine oil has not reached the predetermined regeneration start dilution ratio, the controller 90 terminates the routine immediately.

Meanwhile, when the flag F2 is at unity in the step S32, the controller 90 determines in a step S36 whether or not the dilution ratio of the engine oil has fallen to a predetermined regeneration end dilution ratio.

If the result of the determination indicates that the dilution ratio of the engine oil has fallen to the predetermined regeneration end dilution ratio, the controller 90 resets the flag F2 to zero in a step S37, and then terminates the routine. If the dilution ratio of the engine oil has not fallen to the predetermined regeneration end dilution ratio, the controller 90 controls the electrically controlled thermostat 74 in a step S36 to raise the engine water temperature, similarly to the step S17 of the first embodiment and the step S26 of the second embodiment. Following the processing of the step S36, the controller 90 terminates the routine.

The predetermined regeneration start dilution ratio and the predetermined regeneration end dilution ratio are set in advance through experiment.

Referring to FIGS. 10A-10D, the results of execution of this diluted oil regenerating routine will be described.

While the oil dilution ratio is small, the controller 90 executes the processing from the step S31 through the step S33 to END upon each execution of the diluted oil regenerating routine.

Figures 10A, 10B, 10C, 10D:
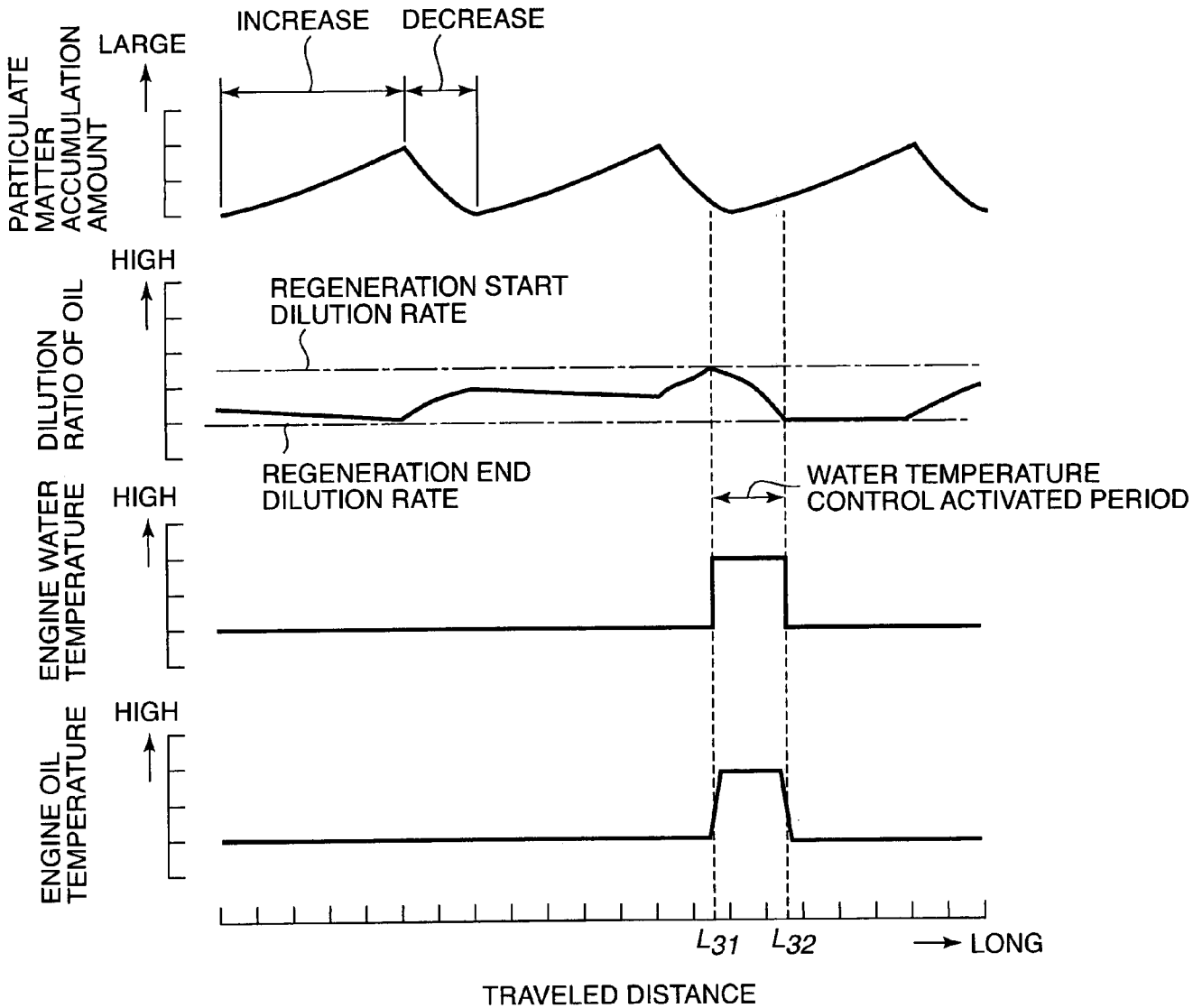
FIGS. 10A-10D are timing charts illustrating the results of execution of the diluted oil regenerating routine executed by the controller, according to the third embodiment of this invention.

When the traveled distance reaches L31, the dilution ratio of the engine oil reaches the predetermined regeneration start dilution ratio, as shown in FIG. 10B. As a result, the determination of the step S33 switches to affirmative, and the controller 90 sets the flag F2 to unity in the step S34. In subsequent diluted oil regenerating routines, the controller 90 executes the processing of the step S36 upon each execution of the routine until the dilution ratio of the engine oil is determined to have fallen to the predetermined regeneration end dilution ratio in the step S35.

As a result, as shown in FIGS. 10C and 10D, the cooling water temperature and the engine oil temperature of the diesel engine 10 both rise. Accordingly, vaporization of the fuel contained in the engine oil is accelerated, and vaporization of the fuel that is post-injected by the fuel injector 12 is also accelerated. Therefore, the fuel dilution ratio of the engine oil decreases as shown in FIG. 10B.

At a traveled distance L32, the controller 90 determines in the step S35 that the dilution ratio of the engine oil has fallen to the predetermined regeneration end dilution ratio, and resets the flag F2 to zero in the step S37. Thereafter, the controller 90 again executes the processing from the step S31 through the step S33 to END until it is determined in the step S33 that the dilution ratio of the engine oil has reached the predetermined regeneration start dilution ratio.

Likewise in this embodiment, as is evident from FIG. 10A, the diluted oil regenerating routine is performed independently of the operation to regenerate the DPF 52. However, by executing the diluted oil regenerating routine, the engine oil that is diluted by the post-injection performed to regenerate the DPF 52 is regenerated at fixed traveled distance intervals. According to this embodiment, similarly to the first embodiment, engine oil can be regenerated without the need for special equipment and without supplying specific thermal energy. Moreover, the beginning and end of regeneration are determined according to the dilution ratio of the engine oil, and hence the determination requires no complicated calculations. As a result, the constitution of the diluted oil regeneration system can be simplified.

The contents of Tokugan 2005-360074, with a filing date of Dec. 14, 2005 in Japan, are hereby incorporated by reference.

Although the invention has been described above with reference to certain embodiments of the invention, the invention is not limited to the embodiments described above. Modifications and variations of the embodiments described above will occur to those skilled in the art, within the scope of the claims.

For example, in each of the above embodiments, the parameters required for control are detected using sensors, but this invention can be applied to any diluted oil regeneration device which can perform the claimed control using the claimed parameters regardless of how the parameters are acquired.

In each of the above embodiments, this invention is applied to the diesel engine 10, but this invention may also be applied to a gasoline engine.

The embodiments of this invention in which an exclusive property or privilege is claimed are defined as follows:

What is claimed is:

1. A diluted oil regeneration device which regenerates an engine oil diluted with a fuel an internal combustion engine for a vehicle, comprising:

a mechanism which raises a temperature of the engine oil; and a programmable controller programmed to:

determine whether or not the engine oil needs to be regenerated, and control the mechanism to raise the temperature of the engine oil over a predetermined time period, when the engine oil needs to be regenerated, wherein the engine oil lubricates the engine which comprises a piston and a fuel injector which supplies the fuel to a combustion chamber formed by the piston.

2. The diluted oil regeneration device as defined in claim 1, wherein the internal combustion engine comprises a water cooling device which cools the internal combustion engine using a cooling water, and the oil temperature raising mechanism comprises an electrically controlled thermostat which raises the temperature of the engine oil by halting heat radiation of the cooling water in the water cooling device.

3. The diluted oil regeneration device as defined in claim 2, wherein the water cooling device comprises a radiator, a cooling water passage which circulates the cooling water that has cooled the internal combustion engine to the radiator, and a bypass passage which bypasses the radiator, and the electrically controlled thermostat comprises a valve which selectively connects the cooling water passage to a circulation path which passes through the radiator and a circulation path which passes through the bypass passage.

4. The diluted oil regeneration device as defined in claim 1, wherein the controller is further programmed to determine that the engine oil needs to be regenerated when a traveled distance of the vehicle reaches a predetermined regeneration start distance.

5. The diluted oil regeneration device as defined in claim 4, wherein the controller is further programmed to determine that the predetermined time period has ended when the traveled distance of the vehicle reaches a predetermined regeneration end distance.

6. The diluted oil regeneration device as defined in claim 1, wherein the controller is further programmed to determine that the engine oil needs to be regenerated when a fuel dilution ratio of the engine oil reaches a predetermined regeneration start dilution ratio.

7. The diluted oil regeneration device as defined in claim 6, wherein the controller is further programmed to calculate the dilution ratio of the engine oil on the basis of a fuel injection flow rate and a fuel injection duration of the fuel injector.

8. The diluted oil regeneration device as defined in claim 6, wherein the controller is further programmed to determine that the predetermined time period has ended when the dilution ratio of the engine oil falls to a predetermined regeneration end dilution ratio.

9. The diluted oil regeneration device as defined in claim 1, wherein the internal combustion engine is a diesel engine comprising a diesel particulate filter which traps a particulate matter contained in an exhaust gas, the diesel particulate filter being regenerated by burning the trapped particulate matter at a high temperature, and a catalyst device which generates a reaction heat by promoting an oxidation reaction of an unburned fuel upstream of the diesel particulate filter, and supplies the reaction heat to the diesel particulate filter to regenerate the diesel particulate filter, and wherein the controller is further programmed to:

determine whether or not the diesel particulate filter needs to be regenerated; and supply the catalyst device with the unburned fuel by causing the fuel injector to execute a post-injection and determine that the engine oil needs to be regenerated, when the diesel particulate filter needs to be regenerated.

10. The diluted oil regeneration device as defined in claim 9, wherein the controller is further programmed to estimate a trapped particulate matter amount in the diesel particulate filter, and determine that the diesel particulate filter needs to be regenerated when the trapped particulate matter amount reaches a predetermined amount.

* * * * *